US005191841A

United States Patent [19]

Gilbert

[11] Patent Number: 5,191,841

[45] Date of Patent: Mar. 9, 1993

[54] RAILROAD BOGIE AND RAIL GRINDER USING THE BOGIE

[75] Inventor: Michael B. Gilbert, Fairmount, Minn.

[73] Assignee: Harsco Corporation, Wormleysburg, Pa.

[21] Appl. No.: 836,526

[22] Filed: Feb. 18, 1992

[51] Int. Cl.[5] ..... B61F 5/00

[52] U.S. Cl. ..... 105/167

[58] Field of Search ..... 105/165, 167, 168, 159, 105/157.1, 169, 171, 176; 51/178, 179

[56] References Cited

U.S. PATENT DOCUMENTS

| | | | |
|---|---|---|---|
| 205,390 | 6/1878 | Hurd | 105/168 |
| 3,254,610 | 6/1966 | Roley | 105/168 |
| 3,338,182 | 8/1967 | Maestrelli | 105/167 |
| 4,461,604 | 7/1984 | Theurer et al. | 51/178 |
| 4,779,384 | 10/1988 | Shoenhair et al. | 51/178 |
| 4,951,424 | 8/1990 | Buhler | 51/178 |

FOREIGN PATENT DOCUMENTS

| | | | |
|---|---|---|---|
| 0007457 | 2/1980 | European Pat. Off. | 105/167 |

*Primary Examiner*—Mark T. Le

*Attorney, Agent, or Firm*—Kerkam, Stowell, Kondracki & Clarke

[57] ABSTRACT

A short wheel base bogie provides stability by using a double pivot arrangement. Wheels are mounted to walking beams on each side of the bogie. The walking beams are mounted for transverse movement relative to corresponding pivot frames. Upon the bogie getting to a curved track section, the walking beam moves transversely in order to maintain the bogie in proper gauge. The bogie is used for a rail grinder vehicle wherein rail grinders are mounted upon the pivot frames such that the rail grinders follow curves in the rails.

21 Claims, 8 Drawing Sheets

RAILROAD BOGIE AND RAIL GRINDER USING THE BOGIE

BACKGROUND OF THE INVENTION

This invention relates to a bogie for supporting a vehicle upon the rails of a railroad track. Further, this invention relates to a rail grinder using the bogie.

Various wheel arrangements have been used for rail vehicles over the years. Vehicles which are sufficiently short may use a two axle four wheel arrangement. However, that design has a wheel base equal to the distance between the two axles. When moving around a tight curve, the long wheel base may hold the wheels at an angle which is not tangent to the curvature of the rail. Depending upon the tightness of the curve and the length of the wheel base, this may cause the wheel flanges to bind against the rail, leading to derailment.

Transit cars and other relatively large rail vehicles which are used on tight curves avoid the problem of out-of-tangent wheels by use of a double bogie eight wheel arrangement. Each bogie has four wheels and pivots (steers) about a central vertical axis. The bogie wheel base is usually short enough (four to five feet) to prevent the out of tangent situation described above. Each bogie has a center pivot corresponding to its central vertical axis such that the bogie may follow the rail curvature.

The prior art bogie system is shown in a schematic top view of FIG. 1 as having four wheels 10 which pivot as a unit about the central pivot corresponding to a vertical axis. In certain applications, such as various rail maintenance vehicles, use of bogies having short wheel bases would be desirable. However, a bogie with a short wheel base is relatively unstable and may oscillate about the center pivot. The instability is caused by the minimal leverage of the wheel flange forces (see FIG. 1) about the center pivot. The tangential forces created by propulsion and rolling resistance try to turn the bogie. This is resisted by the wheel flange forces. If the bogie wheel base is relatively long, the required flange forces are small. However, when the wheel base is relatively small, the flange forces increase. The increase causes the wheel flange to start walking up the rail head. This allows the bogie to pivot. Once the flange force overcomes the tangential forces, the bogie has pivoted and is now out of balance and the oscillation begins. Therefore, center pivot bogies have generally not been suitable for applications where one wishes to have a relatively short wheel base.

Among various prior rail maintenance machines is the RAIL GRINDER of the Shoenhair et al U.S. Pat. No. 4,779,384, issued Oct. 25, 1988, assigned to the assignee of the present invention, and hereby incorporated by reference. That patent disclosed a rail grinder vehicle having numerous grinders mounted thereto and using a two axle four wheel arrangement with a 10 foot wheel base. The grinders have grind stones used to grind out various deformities which occur after use of a rail. The grinders are mounted upon a so-called K frame, which in turn is pivotably connected to a vehicle main frame. The rail grinder of that patent uses a four wheel two axle arrangement of the type discussed above.

The rail grinder of the Shoenhair design has been quite useful. However, the grinder may not be able to grind unusually tight curves. The schematic top view of FIG. 2 shows eight grinding stones 12 (only some labeled) on a vehicle (vehicle not shown for simplicity). As the vehicle goes around a curve in the rails, the grinding stones have a chordal offset which is too large to allow the grinding heads to operate properly.

The problem of grinding stones becoming offset from the rails limits the application of some grinding machines to exclude rail sections having relatively tight curves. At least some designs have used vehicles having separate rail grinding carriages attached underneath the vehicle. The carriages have their own wheels separate from the vehicle wheels and they use the wheels of the carriage to allow the grinding heads to track rail curvature and minimize chordal offset. Although these arrangements may work, they are subject to several disadvantages. They require a relatively larger number of wheels than would otherwise be the case. They complicate the structure of the machine.

OBJECTS AND SUMMARY OF THE INVENTION

Accordingly, it is a primary object of the present invention to provide a new and improved bogie.

A further object of the present invention is to provide a new and improved rail grinder using the new bogie.

A more specific object of the present invention is to provide a bogie which will maintain stability with a relatively short wheel base.

A further object of the present invention is to provide a bogie which has good tracking characteristics.

Yet another object of the present invention is to provide a rail vehicle which can move around tight curves.

A still further object of the present invention is to provide a rail grinder vehicle which can grind around relatively tight curves.

The above and other objects of the present invention which will become more apparent as the description proceeds are realized by an apparatus including a bogie for movement along rails. The bogie has first and second opposite side pivot frames respectively pivotable about separate first and second vertical axes which are offset from a rail direction center line. (The rail direction, as used herein, is simply the straight line corresponding to the direction in which the rails extend. At a particular point in a straight section of track, it would be parallel to the rails. At a particular point in a curved section of track, it would be the direction of a chord. The rail direction center line therefore extends in the rail direction and would be centrally located between the two rails.) First and second pairs of rail engagement wheels respectively are supported by the first and second pivot frames. A first walking beam is movably mounted to the first pivot frame for relative transverse movement and has the first pair of rail engagement wheels mounted thereto. A first gauge maintainer is operably connected to the first walking beam. A tie member is operably connected to cause the first and second pivot frames to pivot in unison at curved rail sections with the first gauge maintainer causing the first walking beam to move transversely relative to the first pivot frame such that the first bogie tends to be maintained in gauge.

The apparatus may further comprise a vehicle main frame with the first bogie mounted thereto. The first gauge maintainer is preferably a first gauge link having a first end pivotably connected to the first walking beam and a second end pivotably fixed relative to the vehicle main frame. The first pivot axis is between the rail direction center line and the first pair of rail engagement wheels. The second pivot axis is between the rail direction center line and the second pair of wheels.

The apparatus may further include a grinder mounted to one of the pivot frames such that the grinder tracks curved rail sections for grinding thereon. The first and second vertical axes preferably extend respectively through the first and second pivot frames.

The first bogie further includes a second walking beam movably mounted to the second pivot frame for relative transverse movement and having the second pair of rail engagement wheels mounted thereon. A second gauge maintainer is operably connected to the second walking beam for causing the second walking beam to move transversely relative to the second pivot frame such that the first bogie tends to be maintained in gauge. (As used herein, a transverse movement or a transversed direction corresponds to movement or direction perpendicular to the rail direction.) The second gauge maintainer is preferably a second gauge link having a first end pivotably connected to the second walking beam.

The first walking beam includes a wheel mount portion extending in the rail direction with the first pair of rail engagement wheels mounted thereon, and a slide portion extending transversely through a hole in the first pivot frame.

The present invention may alternately be described as an apparatus including a first bogie having right and left walking beams, separate pairs of wheels mounted to each of the walking beams, and right and left pivot frames respectively pivotable about separate right and left vertical axes which are offset from a rail direction center line. Each of the pivot frames respectively have the corresponding one of the right and left walking beams transversely movably mounted thereto. The right and left pivot frames are operable to respectively pivot in unison at curved rail sections with each of the walking beams moving relative to the corresponding pivot frame for maintaining the first bogie in gauge. The right vertical axis is between the rail direction center line and the right pair of rail engagement wheels and the left vertical axis is between the rail direction center line and the left pair of rail engagement wheels.

The apparatus may further include a vehicle main frame and have the first bogie mounted to the vehicle main frame and a second bogie mounted to the vehicle main frame, the second bogie constructed and operable as described for the first bogie.

At least one grinder is preferably mounted to each of the right and left pivot frames such that each grinder tracks curved rail sections for grinding thereon. The first bogie preferably includes a tie member operably connected to cause the right and left pivot frames to pivot in unison. The tie member has opposite ends pivotably connected to the right and left pivot frames. The first bogie further includes right and left gauge links pivotably connected respectively to the right and left walking beams and operable to cause shifting respectively of the right and left walking beams to maintain the first bogie in gauge upon pivoting of the right and left pivot frames. Each of the pairs of wheels has a wheel base of less than three feet preferably less than two feet.

The apparatus may further be described as having a vehicle main frame for movement along a railroad track, a first pivot frame mounted at a first side of the vehicle main frame for pivoting about a first vertical axis relative thereto, a first grinder mounted to the first pivot frame, and a first pivot controller operably connected to the first pivot frame for causing the first pivot frame to pivotably follow curves in a rail on a first side such that the first grinder follows rail curves. The distance from the first vertical axis to the first pivot frame is smaller than the distance from the first vertical axis to a rail direction center line.

The apparatus further includes a second pivot frame mounted at a second side of the vehicle main frame for pivoting about a second vertical axis relative thereto. The distance from the second vertical axis to the second pivot frame is smaller than the distance from the second vertical axis to the rail direction center line. A second grinder is mounted to the second pivot frame and a second pivot controller is operably connected to the second pivot frame for causing the second pivot frame to pivotably follow curves in a rail on the second side such that the second grinder follows rail curves. A tie member is pivotably connected at opposite ends to the first and second pivot frames for causing the first and second pivot frames to pivot in unison. The first pivot controller and first pivot frame are part of a first bogie mounted to the vehicle main frame. The first pivot controller includes a first pair of rail engagement wheels supported by the first pivot frame, a first walking beam movably mounted to the first pivot frame for relative transverse movement and having the first pair of rail engagement wheels mounted thereto, and a first gauge maintainer operably connected to the first walking beam. The first gauge maintainer causes the first walking beam to move transversely relative to the first pivot frame such that the first bogie tends to be maintained in gauge.

BRIEF DESCRIPTION OF THE DRAWINGS

The above and other features of the present invention will be more readily understood when the following detailed description is considered in conjunction with the accompanying drawings wherein like characters represent like parts throughout the several views and in which.

DETAILED DESCRIPTION .

Figure 3:
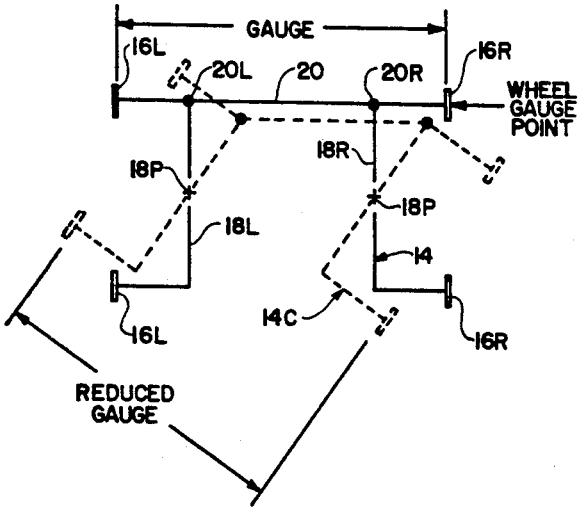
FIG. 3 shows a top view schematic illustrating a possible double pivot bogie arrangement.

Turning now to FIG. 3, a possible double pivot bogie arrangement will be discussed in order to explain the operation of the present invention. In FIG. 3, a bogie 14 has right and left pairs of rail engagement wheels 16R and 16L respectively. The wheels are mounted to right and left pivot frames 18R and 18L which are pivotably connected at points 20R and 20L to a tie rod 20. The components as labeled are in a position corresponding to straight rails. However, each of the pivot frames 18R and 18L is pivotably fixed to the vehicle (vehicle not shown) at a vertical pivot axis 18P. Accordingly, when the bogie 14 comes to a section of track which is curved, it shifts to the position shown at 14C. Specifically, each of the pivot frames 18R and 18L pivot about their corresponding pivot points or vertical axes 18P so as to accommodate the curve in the rails (rails not shown). The tie rod 20 causes the pivot frames 18R and 18L to move in unison.

Figure 1:
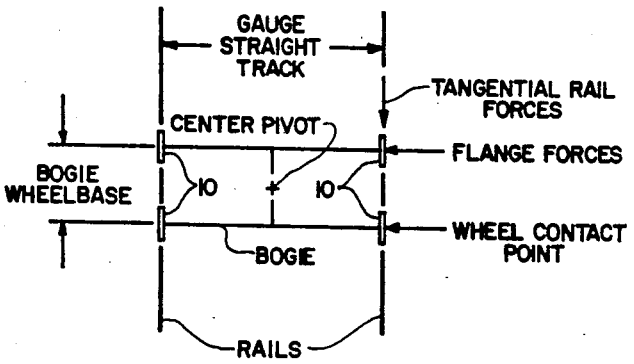
FIG. 1 PRIOR ART
FIG. 1 shows a top view schematic illustrating a prior art center pivot bogie arrangement as discussed above.

The double pivot arrangement of FIG. 3 reduces the leverage of the tangential forces (refer back to FIG. 1 for directions of these forces). The reduction in the leverage of the tangential forces in turn reduces the flange forces and leads to a stable system. However, unlike a center pivot bogie, the double pivot bogie of FIG. 3 changes its gauge as it pivots. Thus, the gauge is reduced in the position corresponding to 14C.

Figure 4:
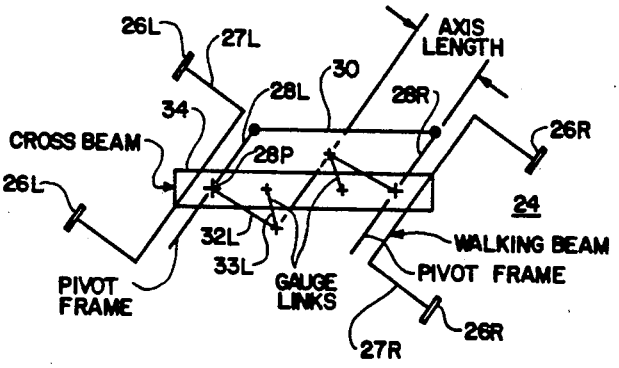
FIG. 4 shows a top view schematic illustrating the principle of operation of the bogie of the present invention.

To eliminate the gauge reduction problem of a double pivot bogie, the present invention allows the wheels to translate horizontally a controlled distance as will be simply explained in connection with FIG. 4 showing a double pivot walking beam bogie 24 according to the present invention. Right and left pairs of rail engagement wheels 26R and 26L are mounted to corresponding right and left walking beams 27R and 27L. Each of the walking beams is mounted to a corresponding right or left pivot frame 28R or 28L pivotably connected to a tie rod 30 in the same fashion as discussed above in connection with tie rod 20. Each of the walking beams such as 27L includes a slide portion 32L pivotably connected to a gauge link 33L which in turn is pivotably mounted to a cross beam 34. The cross beam 34 would be mounted to the vehicle main frame (not shown in FIG. 4). For ease of illustration, the right side components corresponding to 32L and 33L have not been labeled. It will be understood that the structure is symmetric about a rail direction center line (upon a straight section of track, the rail direction corresponds to the lengthwise direction of a vehicle mounted on the track).

Upon the bogie 24 of FIG. 4 encountering a curved section of track, the wheels such as 26L will follow the curve in the rails and cause the left pivot frame 28L to pivot about a vertical pivot axis 28P. The tie rod 30 insures that the right pivot frame 28R moves in unison with the left pivot frame. The walking beams 27L and 27R will avoid the gauge reduction problem discussed with respect to FIG. 3. Specifically, the slide portion 32L of walking beam 27L is slidably mounted to the pivot frame 28L and will slide relative to the pivot frame 28L in a field direction (transverse to the rail direction) so as to maintain the bogie 24 in gauge. The right walking beam 28R will operate in the same fashion. The gauge link 33L serves as a gauge maintainer to maintain the gauge of the bogie 24.

Figure 5:
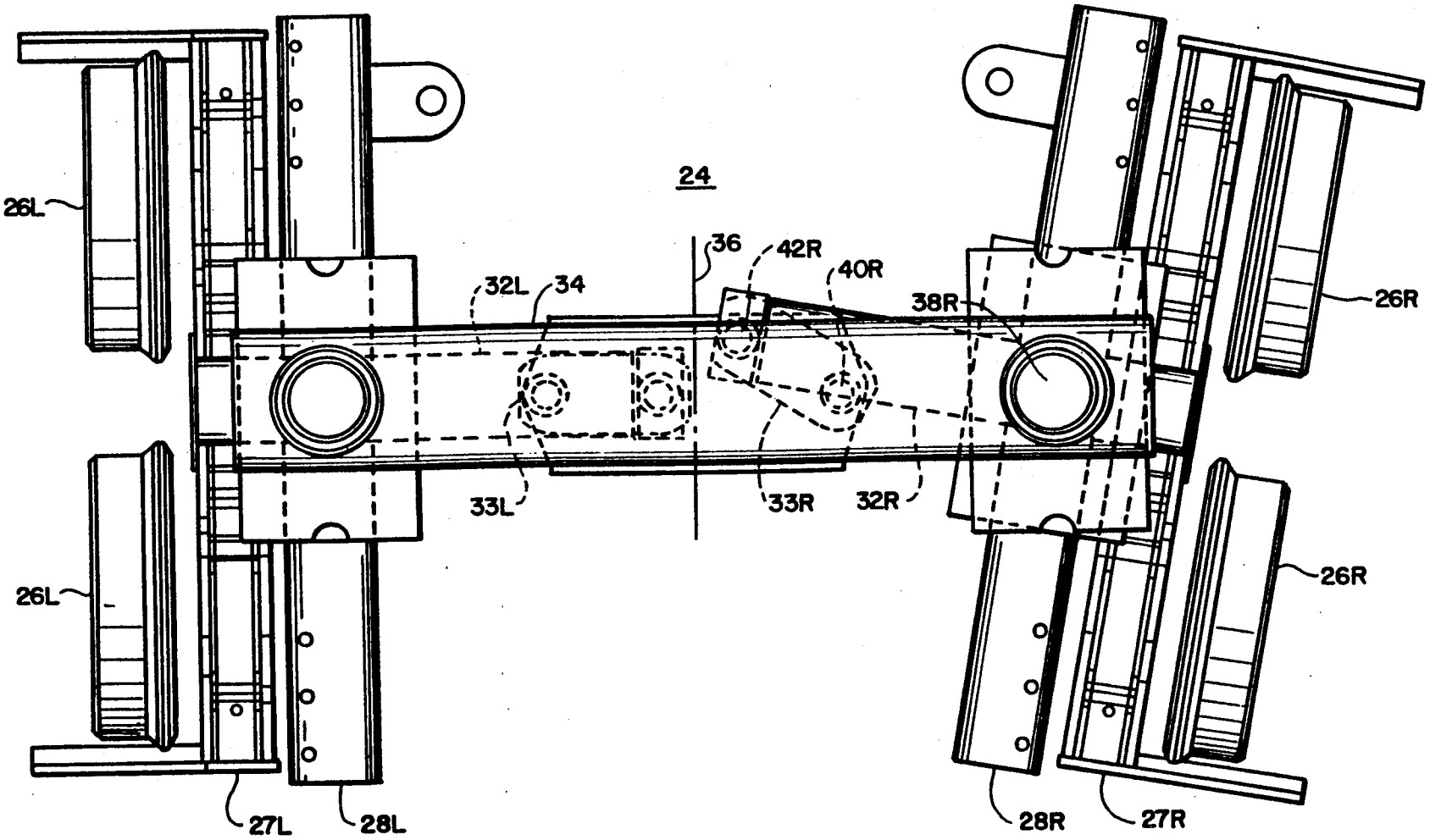
FIG. 5 shows a top view of the bogie according to the present invention.

Turning now to FIG. 5, a top view of the double pivot walking beam bogie 24 is shown. For ease of illustration, the tie rod 30 is not shown in FIG. 5. The left side components of FIG. 5 show the positions corresponding to the bogie 24 being on a straight section of track, whereas the right side components of FIG. 5 correspond to positions assumed upon a curved section of track. It will of course be understood that the two sides would normally move in unison (i.e., at the same time, but they are not necessarily parallel at all times) and that FIG. 5 simply shows them in different positions for descriptive purposes.

Referring to the left side of FIG. 5 initially, the wheels 26L, walking beam 27L, and pivot frame 28L are all oriented as though the vehicle was proceeding along a straight section of track parallel to the vehicle lengthwise direction 36. Referring now to the right side of FIG. 5, upon coming to a curve in the track, the right wheels 26R follow the rails (rails not shown) and in turn cause the illustrated inclination of the walking beam 27R and pivot frame 28R by the pivoting of pivot frame 28R about right vertical pivot axis 38R. Considering that the end 40R of gauge link 33R is pivotably fixed to the main frame (not shown) by way of cross beam 34 (and other components to be discussed later), the slide portion 32R of walking beam 27R moves to the position shown. The interaction between gauge link 33R and slide portion 32R by way of their pivot connection 42R causes the walking beam 27R and the wheels 26R mounted thereon to move outwardly (in a field direction, to the right in FIG. 5). This helps avoid the reduced gauge problem discussed with respect to FIG. 3.

Figure 6:
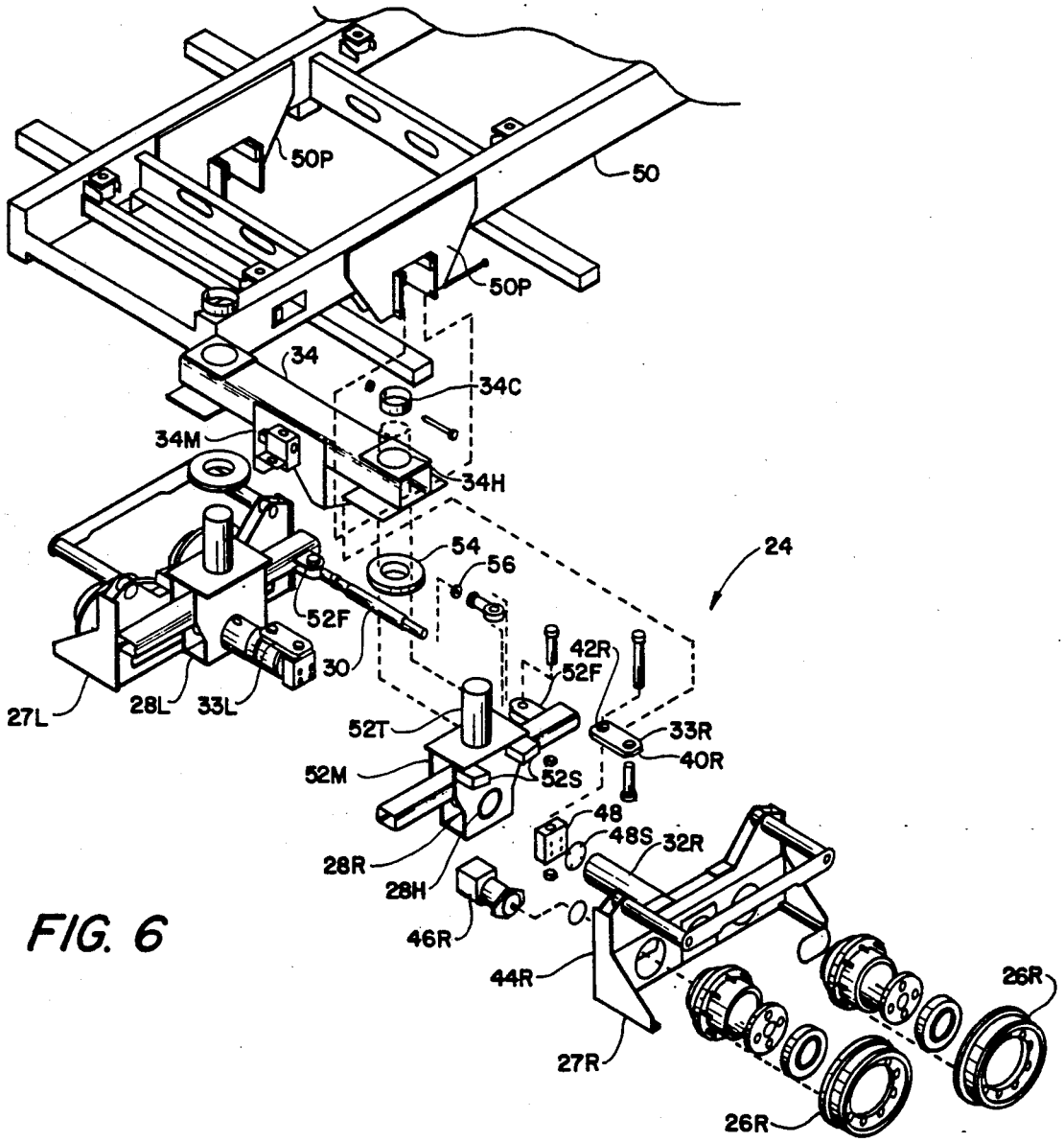
FIG. 6 shows an exploded perspective view of a bogie according to the present invention.
Figure 7:
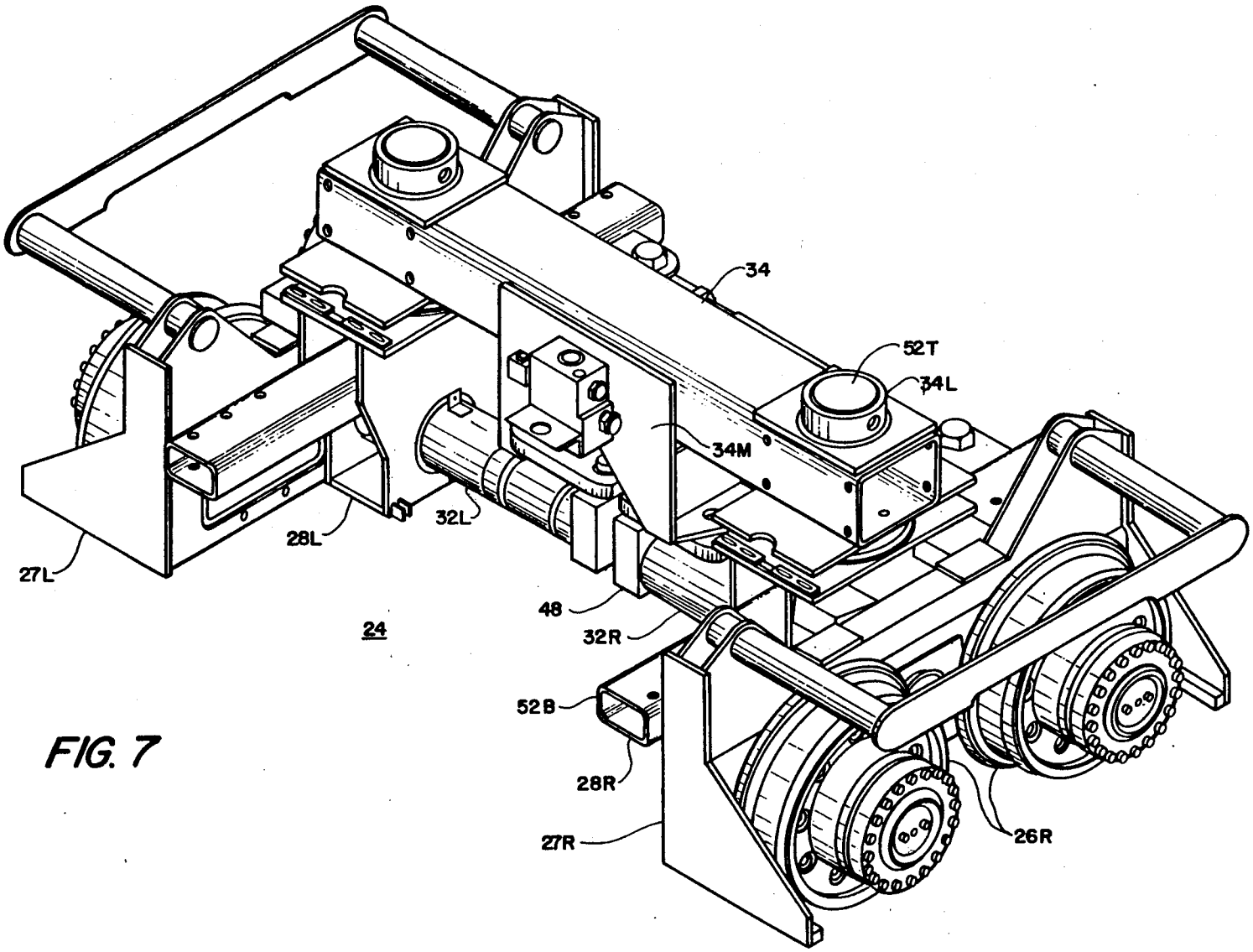
FIG. 7 shows a perspective view of the bogie of the present invention.
Figure 8:
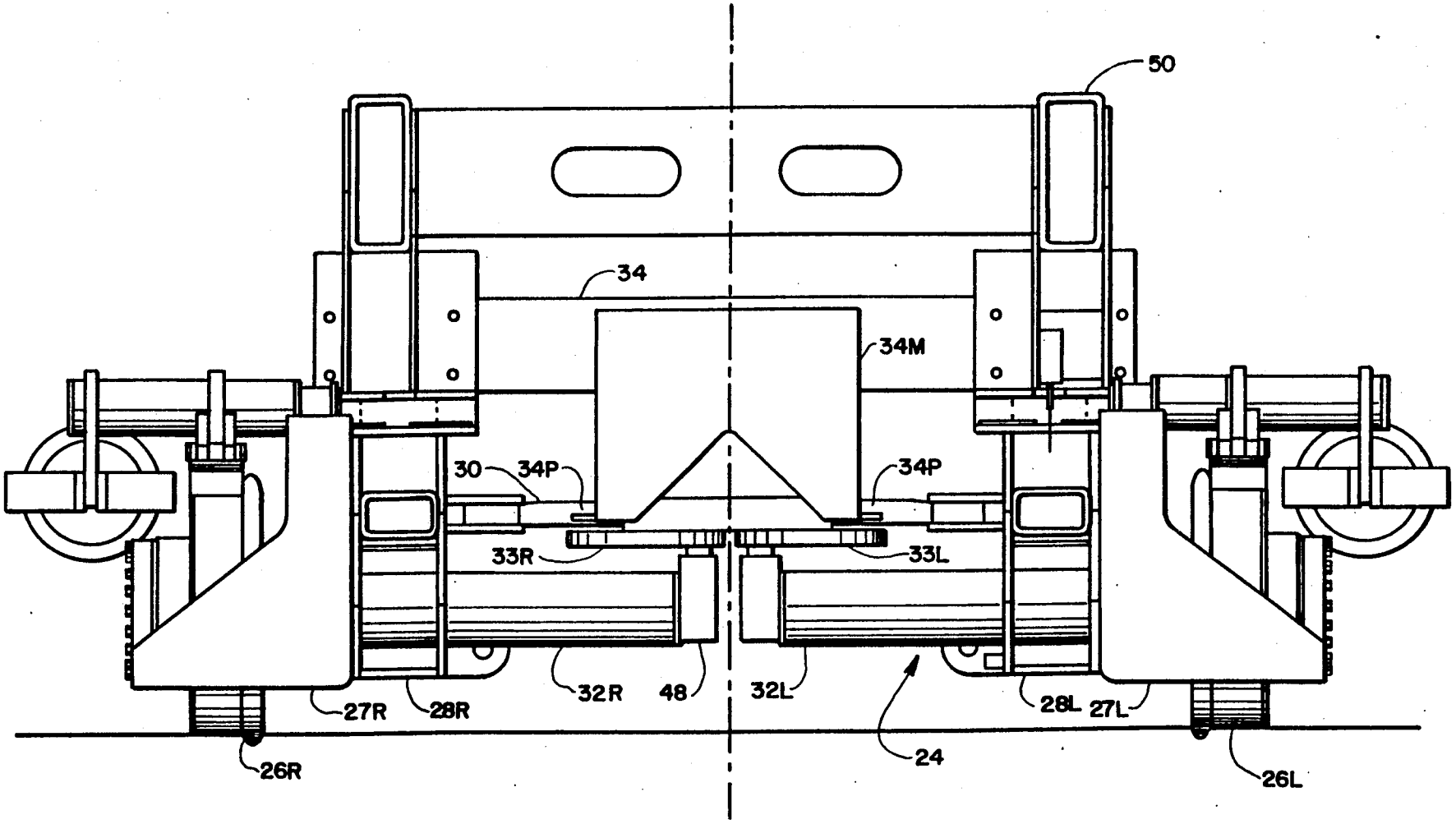
FIG. 8 is a front view of the bogie mounted upon a main frame.

Turning now to FIGS. 6, 7, and 8, the construction of the bogie 24 will be explained in more detail. As the structure is symmetric, the description which follows will generally concentrate upon the right side components and it will be understood that the illustrated left side components operate in the same way.

Conventional rail engagement wheels 26R are mounted to the field side of a wheel mount portion 44R of the walking beam 27R. The wheel mount portion 44R, which extends in the rail direction, also may have a hydraulic motor 46R to power at least one of the wheels 26R. The wheel mount portion 44R of the walking beam 27R is welded or otherwise fixed to a slide portion 32R which extends transversely (i.e., perpendicular to the rail direction). Mounted to the inside or gauge end of the slide portion 32R is a block 48. The block 48 may be bolted or otherwise fixed to the slide portion 32R either directly or with shim plates such as 46S disposed there between. The shim plates 48S (only one shown) may have holes corresponding to the bolt holes for the bolts which secure block 48 to slide portion 32R. The use of one or more shims such as 48S allows for minor adjustments in operation of the walking beam 27R to insure that it functions properly to maintain the bogie 24 at gauge. A movable end 42R of gauge link 33R is bolted to the block 48 such that this end of link 33R is pivotably connected to the walking beam 27R. The end 42R would include a ball bushing (spherical portion captured within a spherical cavity, the spherical portion having a hole into which the bolt may screw). The ball bushing (not separately labeled) allows slight misalignment or rotation of walking beam 27R about the axis of its slide portion 32R. A second end 40R of the gauge link 33R is pivotably fixed to a main frame 50 by way of cross beam 34 and other components. Specifically, cross beam 34 is mounted to main frame 50 by way of mounting plate 50P. Cross beam 34 has a mounting structure 34M extending downward from the cross beam 34. The mount 34M (referring especially now to FIG. 8) has identical portions extending in front and behind the cross beam 34 and has plates 34P extending between the front and back portions (i.e., perpendicular to the plane of view of FIG. 8). The end 40R of gauge link 33R is pivotably fixed to the plate 34P. The end 40R may include a ball bushing for the connection to provide for any slight misalignments or rotation.

The slide portion 32R of walking beam 27R is slidably mounted to extend within hole 28H (refer especially to FIG. 6) of the pivot frame 28R. Specifically, the pivot frame 28R includes a mount structure 52M having the illustrated two downwardly extending parallel plates with a connecting plate at the bottom there between. The hole 28H, which serves as a mounting means, corresponds to a steel tube extending between the two plates and having a bearing lining or coating to allow the slide portion 32R to easily slide therein. Additionally, the mounting of slide portion 32R within hole 28H allows slight rotation of walking beam 27R relative to the pivot frame 28R. Stops 52S prevent over rotation walking beam 27R relative to pivot frame 28R when a wheel contacts an obstruction the vehicle is lifted by a crane. The pivot frame 28R includes a beam 52B extending in the rail direction. When the bogie 24 is on a straight section of track, the beam 52B extends in the vehicle lengthwise direction. The top of the pivot frame 28R includes a tube 52T captured to rotate within a hole 34H in cross beam 34 by way of a locking collar 34C bolted through a hole in tube 52T A rubber spacer collar 54 is around tube 52T. The hole 34H may correspond to a steel tube running through cross beam 34 and having a bearing lining or coating. The bearing lining may, as with other bearing liners referred to herein, be a self-lubricating material. The tube 52T may be considered as a pivot means which causes rotation of the pivot frame 28R upon wheels 26R following a change in curvature of the rail.

The tie rod 30 is pivotably connected at opposite ends to the right and left pivot frames 28R and 28L. Specifically, the tie rod 30 is pivotably connected to flanges 52F. The tie rod 30 may include ball bushings at each end such as 56 to allow slight misalignment between the two pivot frames. Additionally, the tie rod 30 may include any of numerous common length adjustment devices (not shown) to allow one to fine tune the connection between the right and left pivot frames 28R and 28L.

The bogie 24 as shown in FIGS. 4–8 may be used on various kinds of rail vehicles or cars to provide a short wheel base, stable bogie. Among other applications, such a bogie may be useful in transit cars or other rail vehicles which travel on rails having relatively tight curves. Further, such a bogie, which preferably has a wheel base (distance from center of front wheel in a bogie to center of back wheel in the bogie) of less than two feet, is especially well suited for use in a rail grinder vehicle similar to that disclosed in the incorporated by reference Shoenhair patent. Using such a bogie for a rail grinder vehicle will now be discussed with reference initially to FIG. 9.

Figure 9:
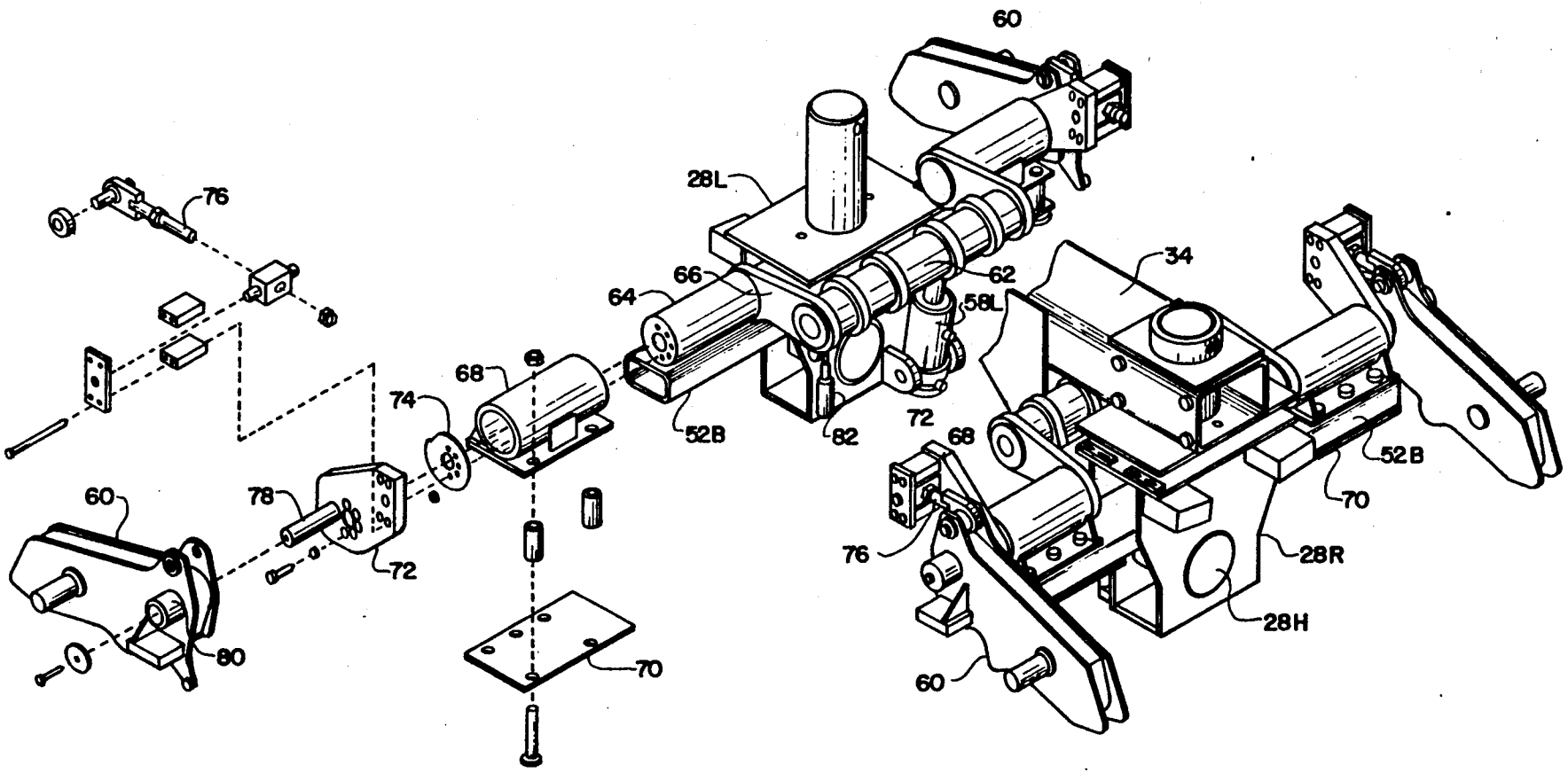
FIG. 9 is an exploded perspective view showing the mounting of grinders upon pivot frames as used with the present invention.

FIG. 9 shows how a grinder may be mounted at each end of the beam 52B of the right and left pivot frames 28R and 28L. For ease of illustration, the walking beams are not illustrated in FIG. 9. As the grinder structures associated with right pivot frame 28R and left pivot frame 28L are identical, an explanation of components on one side will be sufficient. Referring primarily to the left side components of FIG. 9, a double-acting hydraulic cylinder 58L is used to raise and lower grinder members 60 mounted at opposite ends of the beam 52B. The rod end of cylinder 58L moves tube 62 upward causing the rotation of tube 64 by way of arm 66. The tube 64 is captured within a sleeve 68 bolted to the beam 52B and having a backup plate 70 bolted thereto as reinforcement. The metal sleeve 68 may have bearing lining therein to allow easy rotation of tube 64. Bolted to an end of the tube 64 is a member 72 having a series of bolt holes therein. In between the member 72 and the tube 64 is a shim or spacer 74 which is used for fine tuning the position of the grinder member 60. Mounted to the member 72 is an adjustable length connect rod 76 and a peg 78 which is rotatably captured within a hole 80 in grinder member 60. An optional hydraulic cylinder 82 may be used to activate a travel lock of any of various known designs. The travel lock or latch (not shown) simply locks the grinder members 60 in an upper position. As perhaps best shown at the left end of the right pivot frame 28R in FIG. 9, the grinder member 60 is in an upper or travel position. Upon plate 72 rotating clockwise about the axis of sleeve 68, the peg 78 (visible only in the exploded end of pivot frame 28L) causes the member 60 to move downwardly into an operative position ready for grinding. The connect rod 76 is connected to a portion of the grinder member 60 and helps to maintain the proper orientation of the grinder member 60 as it moves downwardly into position ready for grinding upon rails.

Figure 2:
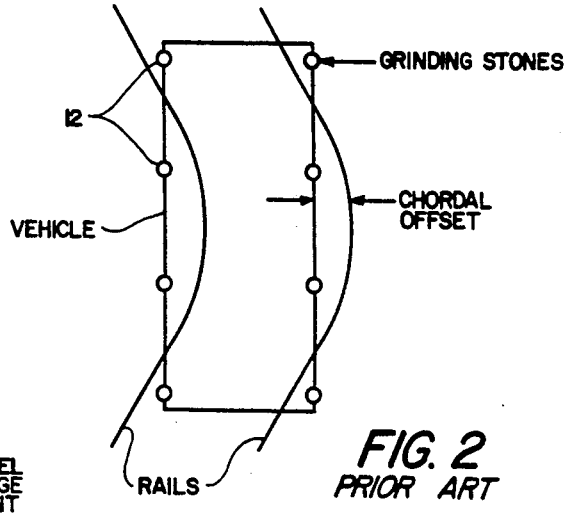
FIG. 2 PRIOR ART
FIG. 2 shows a top view schematic illustrating a chordal offset problem with prior art grinders as discussed above.

It will be noted that the grinder members 60 of FIG. 9 correspond essentially to the grinder members 38 of the incorporated by reference Shoenhair patent (see especially FIGS. 5–10C). Mounted to each of the grinder members 60 of FIG. 9 would be a grinder and associated intermediate structures as described in more detail in the incorporated by reference Shoenhair patent. The grinder (not shown in FIG. 9) mounted to the grinder member 60 would operate in the same fashion as described for the grinders of the incorporated by reference Shoenhair patent. However, the grinders mounted to grinder members 60 would, by virtue of the fact that they are mounted to the pivot frames of the present bogie, avoid the chordal offset problem of FIG. 2. The grinders would therefore be able to grind in relatively tight curves of rail.

Figure 10:
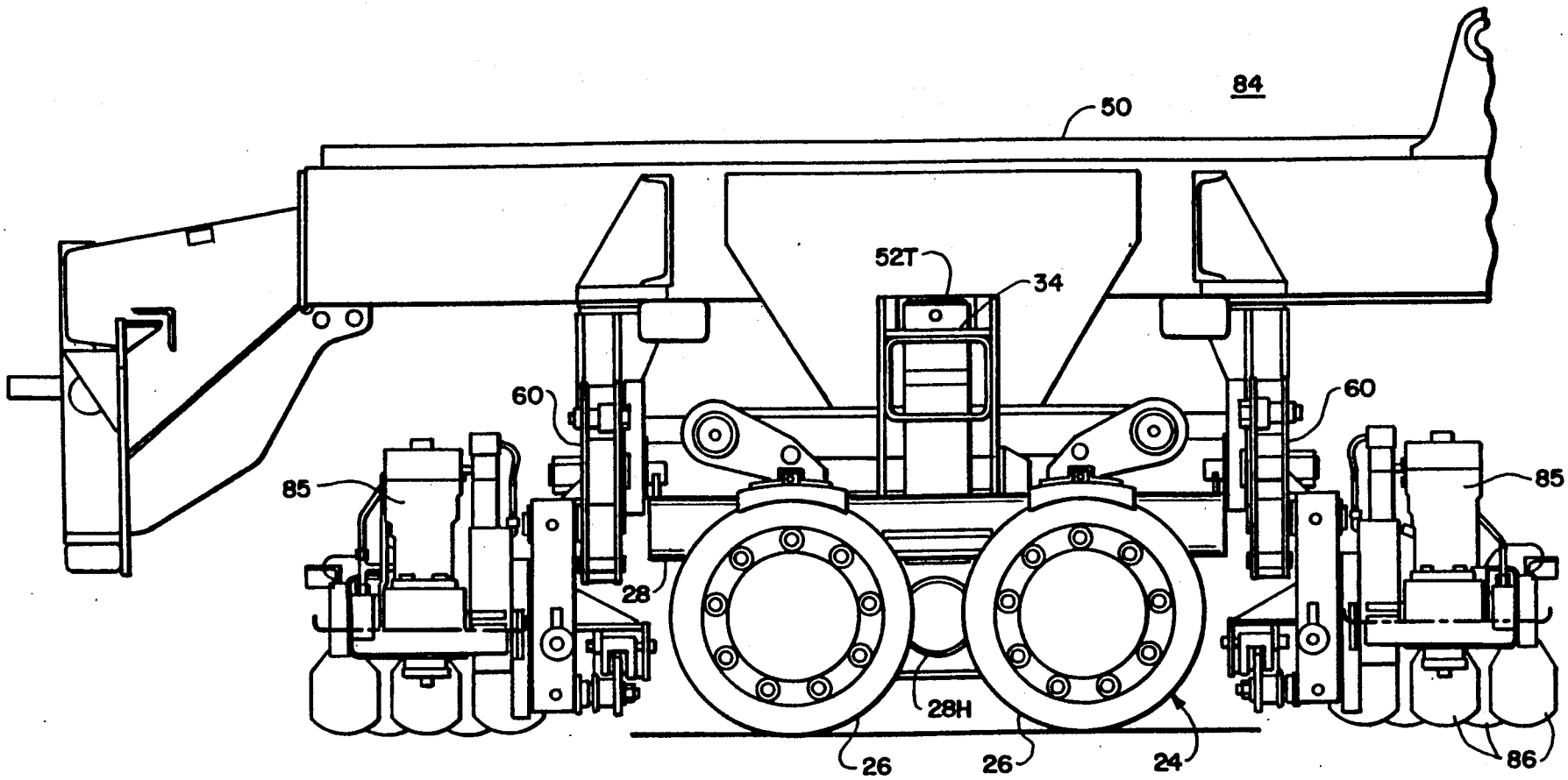
FIG. 10 shows a side view of a portion of a rail grinder vehicle according to the present invention.

Referring now to FIG. 10, a rail grinder vehicle 84 according to the present invention has the main frame 50 with the cross beam 34 mounted thereto. Mounted to the cross beam 34 is a pivot frame 28 with wheels 26 mounted to a walking beam (not shown) slidably received within hole 28H. Grinders 85 mounted at opposite ends of the pivot frame 28 by way of grinder members 60. The grinders 85 include the components described in detail for the grinder structures in the Shoenhair patent. Additionally, FIG. 10 illustrates use of various hanging pieces of metal 86 which may simply serve to shield against sparks escaping from the grinder 85 upon a rail. The shields 86 may be of various known designs and are sometimes referred to as wind chimes.

For ease of discussion relative to FIG. 10, the various components such as wheels 26 and pivot axis 28 have not been referred to as being either right or left side components. In practice, they would be either one or the other as discussed previously. The vehicle 84, only a portion of which is shown in FIG. 10, would have identically constructed mirror image front and back double pivot walking beam bogies 24. Each of the two pivot frames for each bogie would have two grinders. Accordingly, there would be four grinders on each side of the vehicle.

Figure 11:
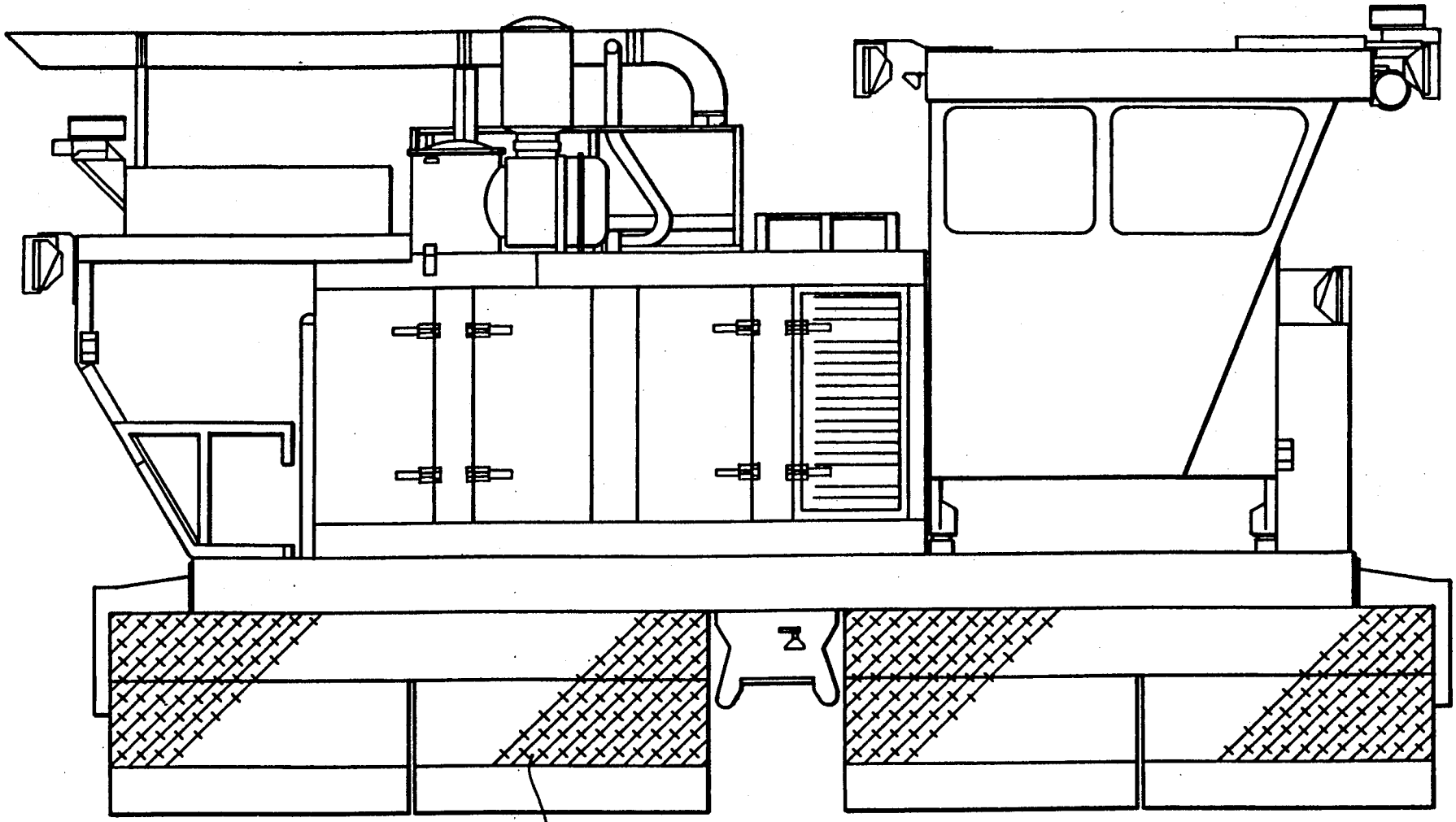
FIG. 11 is a side view of the rail grinder vehicle of the present invention.

FIG. 11 shows a more complete view of the vehicle 84, but most parts of the present invention are not visible as they are disposed behind various spark curtains 88 which are commonly used to catch any sparks which might escape from the shields 86 of FIG. 10. At any rate, the vehicle 84 would be supported upon front and back double pivot walking beam bogies of the type described in detail and would have grinders mounted upon the various pivot frames.

Although various specific constructions and details have been presented herein, it is to be understood that these are for illustrative purposes only. Various modifications and adaptations will be apparent to those of skill in the art. For example, one might use a double pivot bogie having a single walking beam. In such a design, wheels might be mounted to a pivot frame on one side of the vehicle and would be mounted to a walking beam slidably connected to a pivot frame on the other side of the vehicle. In such a single walking beam design, the single walking beam would provide all the gauge adjustments required to maintain the vehicle in gauge. In view of these and other possible modifications in the present design, the scope of the present invention should be determined by reference to the claims appended hereto.

What is claimed is:

1. An apparatus comprising a first bogie for rails having: first and second opposite side pivot frames respectively pivotable about separate first and second vertical axes which are offset from a rail direction center line, first and second pairs of rail engagement wheels respectively supported by said first and second pivot frames, a first walking beam movably mounted to said first pivot frame via a mounting means for allowing the first walking beam to move transversely relative to said first pivot frame, said first walking beam having said first pair of rail engagement wheels mounted to said first walking beam, a first gauge maintainer operably connected to said first walking beam, and a tie member operably connected to said first and second pivot frames so as to cause said first and second pivot frames to pivot in unison at curved rail sections with said first gauge maintainer causing said first walking beam to move transversely relative to said first pivot frame such that the first bogie tends to be maintained in gauge.

2. The apparatus of claim 1 further comprising a vehicle main frame and wherein said first bogie is mounted to said vehicle main frame, and said first gauge maintainer is a first gauge link having a first end pivotably connected to said first walking beam and second end pivotably fixed relative to said vehicle main frame, and wherein the first vertical axis is between the rail direction center line and said first pair of rail engagement wheels and the second vertical axis is between the rail direction center line and said second pair of rail engagement wheels.

3. The apparatus of claim 2 further comprising a grinder mounted to one of said pivot frames such that said grinder tracks curved rail sections for grinding thereon.

4. The apparatus of claim 1 wherein said first gauge maintainer is a first gauge link having a first end pivotably connected to said first walking beam, and wherein the first vertical axis is between the rail direction center line and said first pair of rail engagement wheels and the second vertical axis is between the rail direction center line and said second pair of rail engagement wheels.

5. The apparatus of claim 4 wherein said first and second vertical axes extend respectively through said first and second pivot frames.

6. The apparatus of claim 5 wherein said first bogie further comprises a second walking beam movably mounted to said second pivot frame via a mounting means for allowing the second walking beam to move transversely relative to said second pivot frame, said second walking beam having said second pair of rail engagement wheels mounted to said second walking beam and a second gauge maintainer operably connected to said second walking beam for causing said second walking beam to move transversely relative to said second pivot frame such that the first bogie tends to be maintained in gauge, said second gauge maintainer being a second gauge link having a first end pivotably connected to said second walking beam.

7. The apparatus of claim 1 wherein said mounting means is a hole in said first pivot frame and said first walking beam includes a wheel mount portion extending in the rail direction with said first pair of rail engagement wheels mounted thereon and a slide portion extending transversely through said hole in said first pivot frame.

8. An apparatus comprising a first bogie having: right and left walking beams, separate right and left pairs of rail engagement wheels respectively mounted to said right and left walking beams, and right and left pivot frames having respective right and left pivot means respectively pivotable about separate right and left vertical axes which are offset from a rail direction center line, each of said pivot frames respectively having the corresponding one of said right and left walking beams transversely movably mounted thereon via a corresponding mounting means, and wherein said right and left pivot means are operable so as to cause said right and left pivot frames to respectively pivot in unison at curved rail sections with corresponding mounting means causing each of said walking beams to move relative to the corresponding pivot frame for maintaining the first bogie in gauge, and wherein the right vertical axis is to the right of the rail direction center line and the left vertical axis is to the left of the rail direction center line.

9. The apparatus of claim 8 further comprising a vehicle main frame and wherein said first bogie is mounted to said vehicle main frame.

10. The apparatus of claim 9 further comprising a second bogie mounted to said vehicle main frame constructed and operable as recited for said first bogie.

11. The apparatus of claim 9 further comprising at least one grinder mounted to each of said right and left pivot frames such that each grinder tracks curved rail sections for grinding thereon.

12. The apparatus of claim 8 wherein said first bogie further comprises a tie member operably connected to said right and left pivot frames to pivot said pivot frames in unison.

13. The apparatus of claim 12 wherein said tie member has opposite ends pivotably connected to said right and left pivot frames and said first bogie further comprises right and left gauge links pivotably connected respectively to said right and left walking beams and operable to cause shifting respectively of said right and left walking beams to maintain the first bogie in gauge upon pivoting of said right and left pivot frames.

14. The apparatus of claim 13 wherein the first bogie has a wheel base of less than two feet.

15. A vehicle supporting bogie connected to a vehicle main frame for movement along a railroad track, comprising a first pivot frame mounted to a first side of said vehicle main frame by a first pivot means having a first vertical axis, a pair of vehicle supporting wheels mounted to said first pivot frame, wherein said first vertical axis is closer to said first pivot frame than to a rail direction center line, a first grinder mounted to said first pivot frame such that said first grinder pivots about said first vertical axis upon pivoting of said first pivot frame, and a first pivot controller including said pair of vehicle supporting wheels and operably connected to said first pivot frame for causing said first pivot frame to pivotally follow curves in a rial on the first side such that said first grinder follows said curves.

16. The vehicle supporting bogie of claim 15 further comprising a second pivot frame mounted at a second side of said vehicle main frame for pivoting about a second vertical axis relative thereto, said second vertical axis being closer to said second pivot frame than to the rail direction center line, a second grinder mounted to said second pivot frame such that said second grinder pivots about said second vertical axis upon pivoting of said second pivot frame, and a second pivot controller operably connected to said second pivot frame for causing said second pivot frame to pivotably follow curves in a rail on the second side such that said second grinder follows rail curves, and a tie member pivotably connected at opposite ends to said first and second pivot frames for causing said first and second pivot frames to pivot in unison.

17. The vehicle supporting bogie of claim 16 wherein said first and second vertical axes extend respectively through said first and second pivot frames.

18. An apparatus comprising a vehicle main frame for movement along a railroad track, a first pivot frame mounted at a first side of said vehicle main frame for pivoting about a first vertical axis relative thereto, said first vertical axis being closer to said first pivot frame than to a rail direction center line, a first grinder mounted to said first pivot frame, and a first pivot controller operably connected to said first pivot frame for causing said first pivot frame to pivotably follow curves in a rail on the first side such that said first grinder follows rail curves;

wherein said first pivot controller and first pivot frame are part of a first bogie mounted to said vehicle main frame, said first pivot controller includes: a first pair of rail engagement wheels supported by said first pivot frame, a first walking beam movably mounted to said first pivot frame via a mounting means for allowing the first walking beam to move transversely relative to said first pivot frame, said walking beam having said first pair of rail engagement wheels mounted to said first walking beam, and a first gauge maintainer operably connected to said first walking beam; and wherein said first gauge maintainer causes said first walking beam to move transversely relative to said first pivot frame such that the first bogie tends to be maintained in gauge.

19. The apparatus of claim 18 wherein said mounting means is a hole in said first pivot frame and said first walking beam includes a wheel mount portion extending in the rail direction with said first pair of rail engagement wheels mounted thereon and a slide portion extending transversely through said hole in said first pivot frame.

20. The apparatus of claim 18 wherein said first gauge maintainer is a first gauge link having a first end pivotably connected to said first walking beam and a second end pivotably fixed relative to said vehicle main frame.

21. An apparatus comprising a vehicle main frame for movement alnog a railroad track and having first and second sides and first and second ends; a first pivot frame mounted to said first side of said vehicle main frame by a first pivot means having a first vertical axis, said first vertical axis being closer to said first pivot frame than to a rail direction center line; a first grinder mounted to said first pivot frame such that said first grinder pivots about said first vertical axis upon pivoting of said first pivot frame; a first pivot controller operably connected to said first pivot frame for causing said first pivot frame to pivotally follow curves in a rail on the first side such that said first grinder follows said curves; said first pivot controller including a pair of rail engagement wheels at said first side and mounted to said first pivot frame via a wheel mounting means for rotation about a pair of corresponding horizontal wheel rotation axes and for allowing said pivot frame and said pair of rail engagement wheels to pivot in unison about said first vertical axis; said first grinder located between said first end of said main frame and the wheel, of said pair of rail engagement wheels, nearest to the first end of said main frame; said first vertical axis located between said pair of wheel rotation axes; and said first pivot frame, said first grinder, and said pair of rail engagement wheels disposed only on one side of the rail direction center line.

* * * * *

UNITED STATES PATENT AND TRADEMARK OFFICE

CERTIFICATE OF CORRECTION

PATENT NO. : 5,191,841

DATED : March 9, 1993

INVENTOR(S) : Michael B. GILBERT

It is certified that error appears in the above-identified patent and that said Letters Patent is hereby corrected as shown below:

Cover page, Inventor: Change "Fairmount" to -- Fairmont --;

Column 10, line 36, (Claim 8), change "thereon" to -- thereto --;

Column 11, line 16, (Claim 15), change "rial" to -- rail --;

Column 12, line 25, (Claim 21), change "alnog" to -- along --.

Signed and Sealed this

Twenty-third Day of November, 1993

*Attest:*

Bruce Lehman

BRUCE LEHMAN

*Attesting Officer*

*Commissioner of Patents and Trademarks*